US007272993B2

(12) United States Patent
White et al.

(10) Patent No.: US 7,272,993 B2
(45) Date of Patent: Sep. 25, 2007

(54) TOOL AND METHOD FOR REMOVING AND INSTALLING A TAMPER-RESISTANT CAP OF A PEST CONTROL DEVICE

(75) Inventors: Lee M. White, St. Louis, MO (US); Jonathan D. Berger, St. Louis, MO (US); Steven R. Sims, St. Louis, MO (US)

(73) Assignee: Whitmire Micro-Gen Research Laboratories, Inc., St. Louis, MO (US)

( * ) Notice: Subject to any disclaimer, the term of this patent is extended or adjusted under 35 U.S.C. 154(b) by 906 days.

(21) Appl. No.: 10/236,659

(22) Filed: Sep. 6, 2002

(65) Prior Publication Data

US 2004/0045409 A1 Mar. 11, 2004

(51) Int. Cl.
*B67B 7/14* (2006.01)

(52) U.S. Cl. ..... 81/3.4; 81/3.41; 81/176.2

(58) Field of Classification Search ..... 81/3.07, 81/3.29, 3.4, 3.41, 3.56, 176.1–176.3; D8/18, D8/33, 40, 39

See application file for complete search history.

(56) References Cited

U.S. PATENT DOCUMENTS

| | | | | |
|---|---|---|---|---|
| 3,785,225 | A | 1/1974 | McKenna et al. | |
| 3,885,477 | A | 5/1975 | Shook | |
| 4,059,033 | A | 11/1977 | Johnson | |
| 4,914,985 | A * | 4/1990 | Proctor | 81/176.1 |
| 5,003,848 | A | 4/1991 | Ceccucci, Jr. | |
| D319,957 | S * | 9/1991 | Bergmeister | D8/40 |
| 5,161,436 | A | 11/1992 | Stevenson | |
| 5,199,327 | A * | 4/1993 | Stevenson | 81/3.41 |
| 5,213,016 | A | 5/1993 | Kah, Jr. | |
| 5,329,726 | A | 7/1994 | Thorne et al. | |
| 5,735,181 | A | 4/1998 | Anderson | |
| 5,873,193 | A | 2/1999 | Jensen | |
| 5,893,301 | A * | 4/1999 | Hensley et al. | 81/3.09 |
| 5,901,496 | A | 5/1999 | Woodruff | |
| 5,918,410 | A | 7/1999 | Knuppel | |
| 5,927,000 | A | 7/1999 | Bordes, Jr. | |
| 6,003,266 | A | 12/1999 | Woodruff | |
| 6,016,625 | A | 1/2000 | Bishoff et al. | |
| 6,065,241 | A | 5/2000 | Woodruff | |
| 6,071,529 | A | 6/2000 | Ballard et al. | |
| 6,158,166 | A | 12/2000 | Snell et al. | |
| 6,202,342 | B1 | 3/2001 | Edwards | |
| 6,235,301 | B1 | 5/2001 | Ballard et al. | |

(Continued)

*Primary Examiner*—Hadi Shakeri
(74) *Attorney, Agent, or Firm*—Armstrong Teasdale LLP

(57) ABSTRACT

A tool for removing a cap from a pest control device, such as a termite control device. The tool comprises fingers extending generally parallel to one another adapted for frictionally engaging a side edge of the cap. The fingers define a socket for receiving the cap. The socket is slightly smaller than the cap so that engagement of the fingers with the cap induces the fingers to move with respect to the cap to increase the size of the socket. Movement of the fingers induces frictional engagement of the fingers with the cap. Stops extending laterally inwardly in the socket from the fingers are adapted for engaging a top surface of the cap transverse to the side edge of the cap. The fingers and stops cooperate to orient the cap with respect to the tool. The tool may further comprise an extension extending from the tool for manipulating the tool from a remote location. The tool may otherwise include a handle for grasping the tool.

12 Claims, 4 Drawing Sheets

U.S. PATENT DOCUMENTS 6,255,959 B1 7/2001 Lake et al.
6,272,791 B1 8/2001 Pleasants
6,370,811 B1 4/2002 Masterson
2002/0148157 A1 10/2002 Rollins

* cited by examiner

TOOL AND METHOD FOR REMOVING AND INSTALLING A TAMPER-RESISTANT CAP OF A PEST CONTROL DEVICE

BACKGROUND OF THE INVENTION

This invention generally relates to pest control devices, and more particularly to a keyed tool for use in removing and installing a tamper-resistant cap associated with such a pest control device.

Pest control devices are formed in a wide variety of configurations. One type of popular pest control device utilizes a bait to lure the pest into the pest elimination device. An example of such a baiting device is used in control of insects, such as termites, rodents, such as rats, or other pests. With termites, for example, cavities are dug in the ground and bait holders are placed within those cavities. Such bait holders may then be filled with bait, such as wood or poison. Such systems must be inspected periodically, such as every one to three months, to determine if termites are active within the bait holder. When inspecting the bait within the bait holder, it is important that the personnel inspecting the bait not disturb the bait, which may cause the termites to abandon the bait holder altogether. As such, it is important that the bait holders are sealed well, to discourage tampering by unauthorized personnel or other animals, such as pets.

Typically, such bait stations are protected from disturbance by a cap placed over the stations at ground level. The cap serves many purposes, one of which is discouraging people or animals from disturbing the bait. Especially in the case of poison bait, such caps help protect unauthorized people and animals from accessing the bait. In order for authorized personnel to access the bait, however, a convenient removal scheme is necessary that allows easy access to the bait holders. Thus, a removable cap and corresponding tool are needed to adequately secure the bait within the station, while also being convenient to remove for periodic inspections.

SUMMARY OF THE INVENTION

Among the several objects and features of the present invention may be noted the provision of such a tool that permits efficient removal and installation of a pest control device cap; the provision of such a tool that is simple to use; the provision of such a tool that will not cause undue wear upon the cap or pest control device; and the provision of such a tool that allows inspection at ground level without stooping or bending over.

According to one embodiment, a tool for removing a cap from a pest control device is disclosed. The tool comprises fingers extending generally parallel to one another. The fingers are adapted for frictionally engaging a side edge of the cap. The fingers define a socket for receiving the cap. The socket is slightly smaller than the cap, such that engagement of the fingers with the cap induces the fingers to move with respect to the cap to increase the size of the socket defined by the fingers. Stops extend laterally inwardly in said socket from the fingers and are adapted for engaging a top surface of the cap transverse to the side edge of the cap. The fingers and stops further cooperate to orient the cap with respect to the tool, whereby the socket receives the cap and movement of the fingers induces frictional engagement of the fingers with the cap.

In another embodiment, a method for removing a cap from a pest control device comprises engaging fingers of a tool with a side edge of the cap of the pest control device.

The method further comprises rotating the tool such that the cap rotates conjointly and disengages from the pest control device and lifting the tool from the pest control device to lift the cap from the pest control device.

In yet another embodiment, a method for installing a cap on a pest control device comprises the steps of engaging fingers of a tool with a side edge of the cap of a pest control device and engaging the cap against the pest control device with the tool. The method further comprises rotating the tool such that the cap is retained by the pest control device and lifting the tool from the pest control device to disengage the tool from the cap.

In a further embodiment, a pest control device for securely containing bait to attract pests comprises a bait holder and a cap for securing the bait in the bait holder. The cap includes tabs extending laterally from the edge of the cap to engage the bait holder.

Other objects and features will be in part apparent and in part pointed out hereinafter.

BRIEF DESCRIPTION OF THE DRAWINGS

Corresponding reference characters indicate corresponding parts throughout the several views of the drawings.

DETAILED DESCRIPTION OF THE PREFERRED EMBODIMENTS

Figure 1:
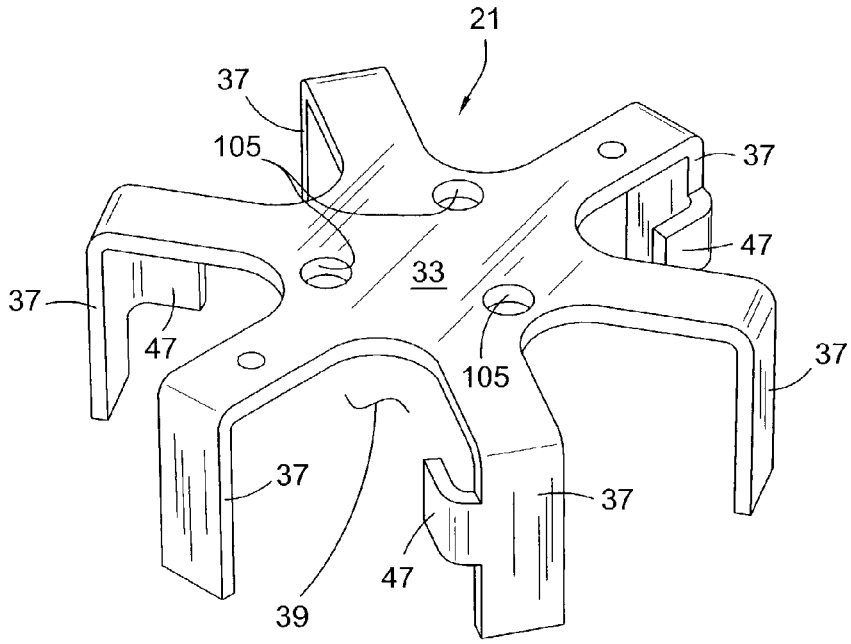
FIG. 1 is a perspective of the pest control device cap removal and installation tool of the present invention.
Figure 3:
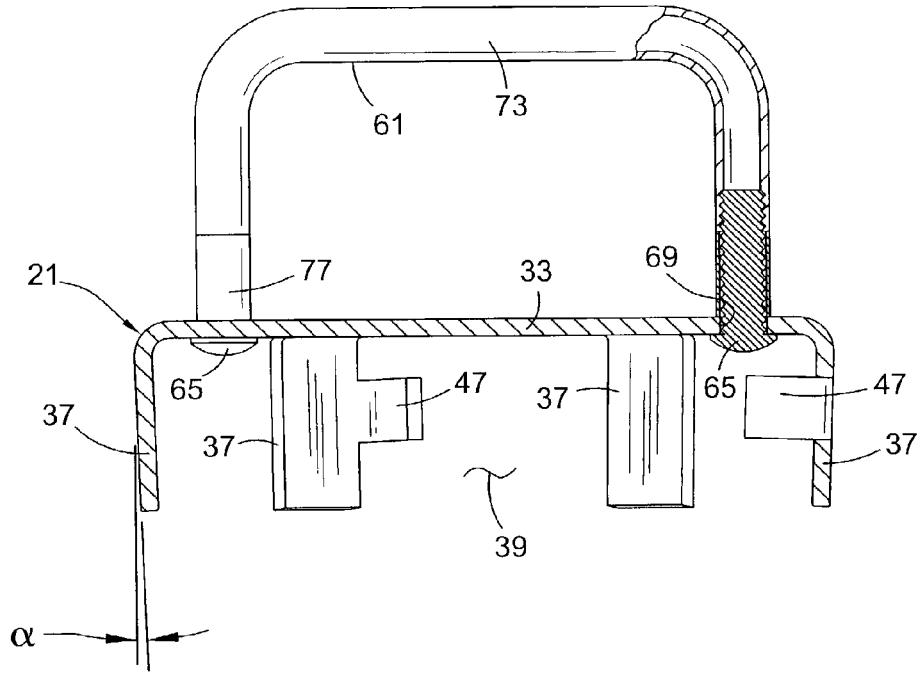
FIG. 3 is a section of the tool taken in a plane including line 3-3 of FIG. 2.
Figure 4:
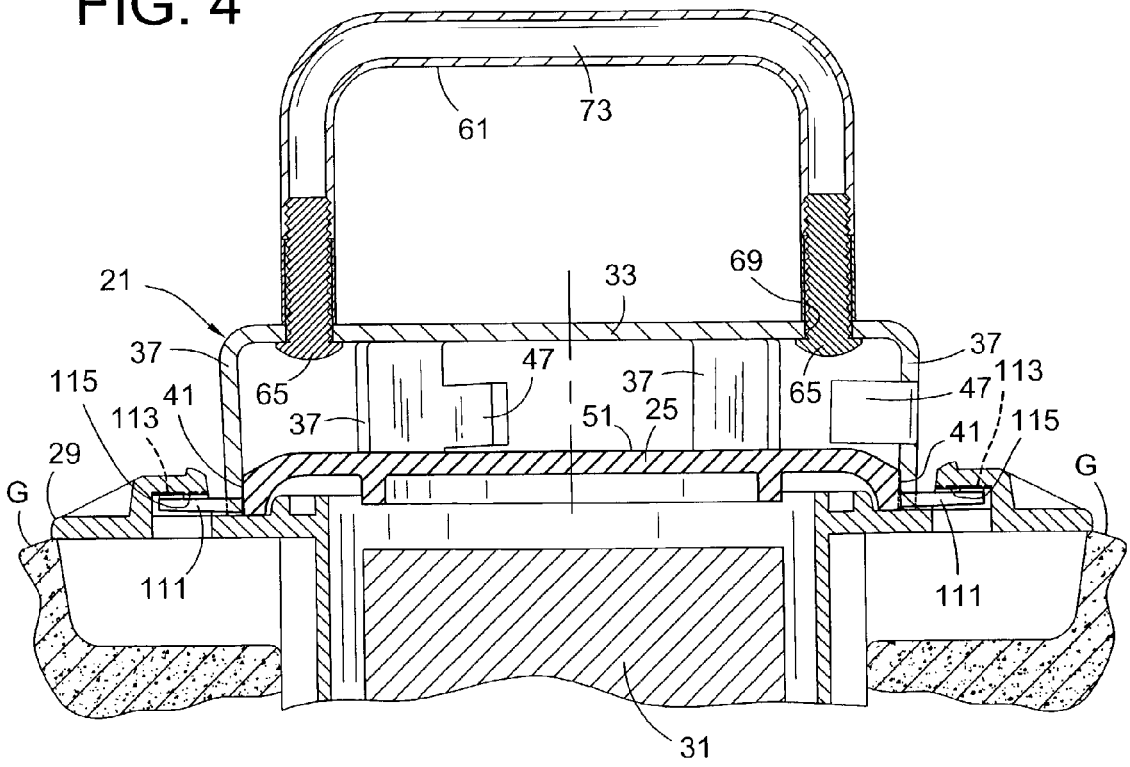
FIG. 4 is a section of the tool taken in a plane including line 4-4 of FIG. 2.
Figure 5:
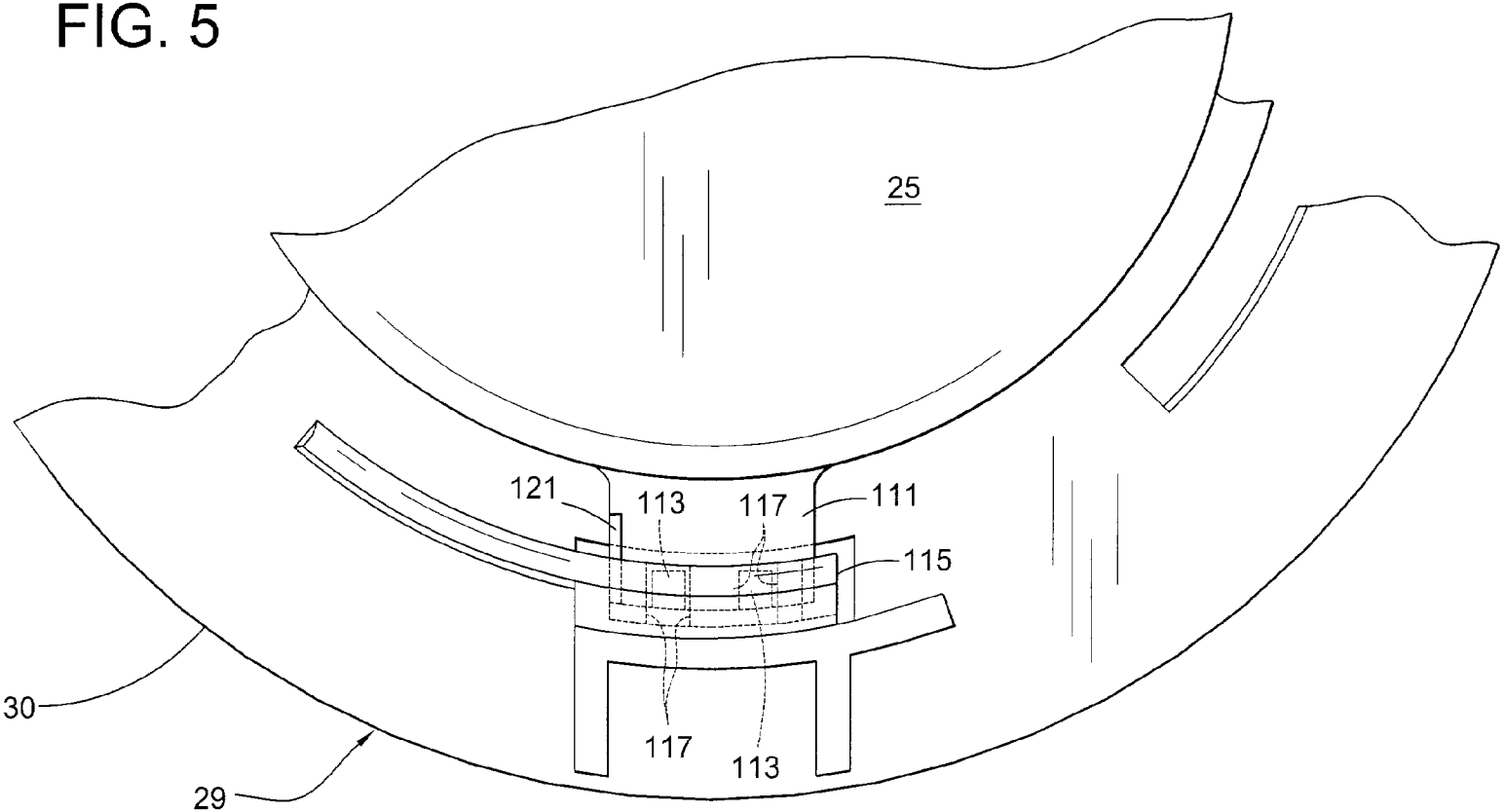
FIG. 5 is a partial top view of a bait holder and cap of the pest control device.

Referring now to the drawings and specifically to FIGS. 1, 4 and 5, a tool of the present invention is generally indicated 21. The tool is designed for removing a cap 25 from a pest control device, generally indicated 29. The pest control device includes a bait holder 30 containing bait 31 and the cap 25, which secures the bait in the bait holder. The tool 21 preferably comprises a hub 33 with fingers 37 extending radially outwardly from the hub. The fingers 37 then bend downward to an orientation generally parallel one another and substantially perpendicular to the cap 25. The fingers 37 cooperate to form a socket 39 for receiving the cap 25 and frictionally engaging a side edge 41 of the cap. In the preferred embodiment, the distal ends of the fingers 37, which engage the side edge 41 of the cap 25, are each formed in an unsprung position that is slightly inward from the side edge of the cap. As the fingers 37 engage the side edge 41, therefore, they move slightly outward, to a sprung position, to receive the side edge of the cap 25. Moving the fingers 37 to a sprung position enhances the frictional engagement of the tool 21 and cap 25, due to the increased force of the fingers pressing against the side edge 41. To achieve this finger position slightly inward from the side edge 41 of the cap 25, the fingers 37 angle slightly inward from vertical at an angle $\alpha$, as shown in FIG. 3. In the preferred embodiment, the angle $\alpha$ is between about one degree and about five degrees, and more particularly about two degrees.

Figure 2:
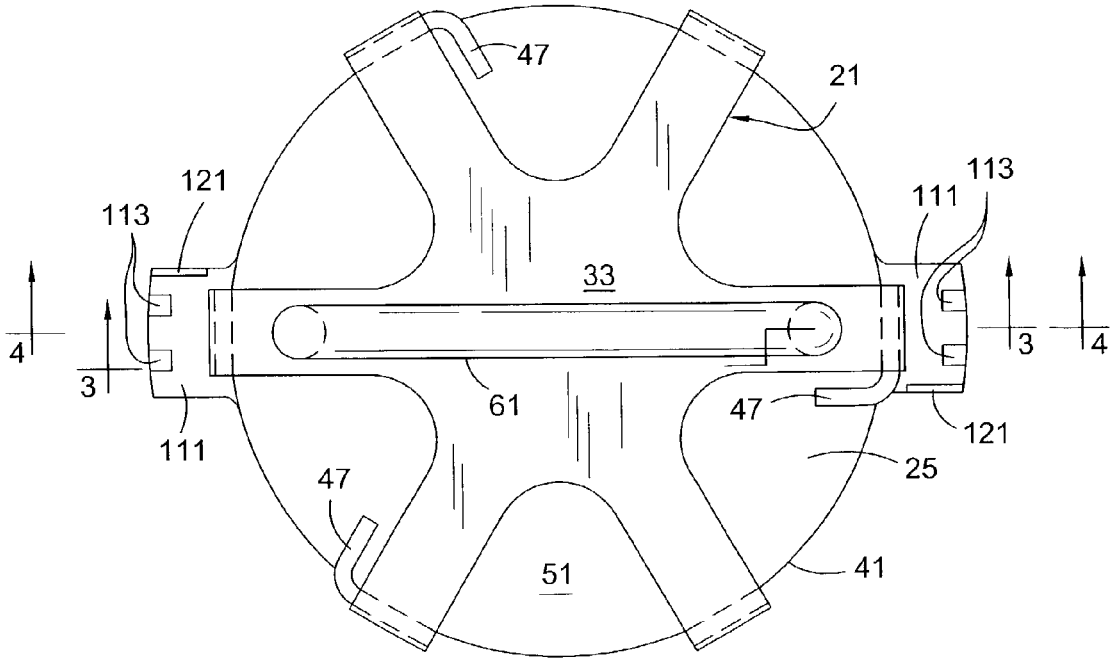
FIG. 2 is a top view of the tool of FIG. 1 with a handle installed and engaging a pest control device cap.

Referring to FIGS. 2 and 4, the fingers 37 are arranged circumferentially about the tool to form a circular socket 39 that corresponds with a circular cap 25. It is contemplated that caps of other shapes, such as polygons (e.g., a triangle, a square, a pentagon, a hexagon, etc.), may be used without departing from the scope of the present invention. A fewer or greater number of fingers 37 may cooperate to form a socket that accommodates a differently-shaped cap 25.

The tool 21 further includes stops 47 extending laterally inwardly in the socket 39 from the fingers 37 for engaging a top surface 51 of the cap 25. The top surface 51 of the cap 25 is transverse to the side edge 41 of the cap. The stops 47 are preferably integrally formed with the fingers 37 themselves, comprising portions of additional material bent laterally inward about a substantially vertical plane. The fingers 37 and stops 47 cooperate to orient the cap 25 with respect to the tool (FIG. 3). If the cap 25 becomes slightly misaligned in the socket 39 of the tool 21, one or more of the stops 47 can engage the top surface 51 of the cap to limit movement of the tool over the cap. As described above and shown in FIG. 4, the fingers 37 must move slightly outward to increase the size of the socket 39 defined by the fingers. As the fingers 37 and stops 47 cooperate to orient and align the cap 25 with respect to the tool 21, the finger movement outward induces frictional engagement of the fingers with the cap.

In the preferred embodiment, the tool 21 includes six fingers 37 and three stops 47. The stops preferably extend from every other finger 37, thereby providing equidistant spacing between the stops for balanced support of the cap 25, irrespective of which side of the cap becomes misaligned in the tool. More generally, the tool 21 may include any number of fingers 37 and stops 47, but preferably includes an even number of fingers, and half as many stops, the stops extending from every other finger.

The tool 21, including the hub 33, fingers 37 and stops 47, is preferably formed from a single piece of material. For example, the tool 21 may be formed from a flat portion of metal, such as aluminum, having a thickness of 0.25 centimeter (0.10 inch) and bent into the required tool shape. Aluminum is particularly ideal, because it allows for reshaping of the tool 21 in the field, for example if the fingers 37 of the tool should become misaligned and no longer provide a proper frictional fit. The tool 21 may also be formed from other suitable materials, such as plastic or fiberglass.

The cap 25 is preferably tamper-resistant to discourage unauthorized individuals from gaining access to the bait 31 in the pest control device 29. The cap 25 includes tabs 111 extending laterally from the edge of the cap for retaining the cap on the pest control device 29. Specifically, the cap 25 rotates into engagement with the pest control device 29, such that cavities 115 of the bait holder 30 are adapted to receive tabs 111 (FIGS. 2, 4 and 5). The tabs 111 and cavities 115 cooperate to hold the cap 25 securely on the pest control device 29. Preferably, the tabs 111 are substantially enclosed by the cavities 115 when the cap 25 is secured to said bait holder 30, thereby limiting the use of the tabs for leverage by an unauthorized individual attempting to remove the cap.

To further enhance this securement, the tabs 111 include raised nibs 113 adapted to fit within channels 117 located inside the cavities 115. The nibs 113 and channels 117 face one another, such that as the tabs 111 are rotated into the cavities 115, the tabs must flex downward to allow the nibs to pass under the top of the cavities and into the channels. Once the cap 25 rotates so that the nibs 113 and channels 117 are aligned, the downward flex of the tabs 111 is somewhat relieved as the nibs move upward into the channels. A slight tension between the nibs 113 and the channels 117 still exists, however, such that the cooperation of the nibs and channels creates an interference fit between the cap 25 and bait holder 30. The interference fit between the nibs 113 and channels 117 may be formed, for example, by configuring the nominal, or unflexed, position of the nibs to be slightly above the uppermost wall of the channels. This interference fit increases the force required to rotate and remove the cap 25, making it relatively difficult to remove an installed cap manually or without the tool 21 of the present invention. For example, such an interference may on the order of about 0.013 centimeter (0.005 inch). Because the cap 25 is relatively smooth and the tabs 111 are substantially enclosed by the cavities 115, the cap is substantially tamper-resistant. By altering the depth of the channels 117 or the height of the nibs 113, the interference can be eliminated, such that the nibs and channels engage one another, yet do not exert a force on one another. Such a configuration reduces the force required to install and remove the cap 25. To further reduce the force required to install and remove the cap 25, the nibs 113 and channels 117 may be configured with a small gap between them.

Other changes in the shape of the cap 25 and bait holder 30 can alter the force required to install or remove the cap. For example, the profile of the lateral edges of the channels 117 may be changed, such that the channel edges are inclined at an angle from vertical, thereby allowing the nibs 113 to more freely exit the channels 117. Because the nibs 113 need not pass a vertical channel edge, the force required to unseat the tabs 111 is substantially lower. Similarly, the nib 113 profile may be similarly changed to lower the resistance as the nibs slide out of the channels 117. In sum, altering the size or shape of the nibs 113 and/or channels 117 allows the interference fit between the cap 25 and bait holder 30 to be fine tuned to create specific installation and removal force characteristics, depending upon the application of the pest control device 29.

In one configuration, the tool 21 further comprises a handle 61 attached to at least one of the fingers 37 for manipulating the tool (FIGS. 2-4). The handle 61 may be shaped in a variety of ways, but preferably is generally U-shaped for manually grasping and manipulating the tool 21. The handle 61 preferably attaches to the fingers 37 with a pair of screws 65 passing upward through two holes 69 in the tool 21. The handle 61 itself comprises a U-shaped upper portion 73 and two spacers 77 between the upper portion and the holes 69. The screws 65 pass freely through the spacers 77, which are unthreaded, and thread into the handle 61 to secure it to the tool 21. The length of the spacers 77 and screws 65 may be varied to create a handle 61 spaced a greater or lesser distance from the hub 33 of the tool 21. Larger spacers 77 may be used, for example, with an individual having larger hands. Where a pest control device 29 is located at ground level G, a user of the tool 21 simply stoops, bends over, or otherwise reaches downward to engage the tool with the cap 25 of the device.

Figure 6:
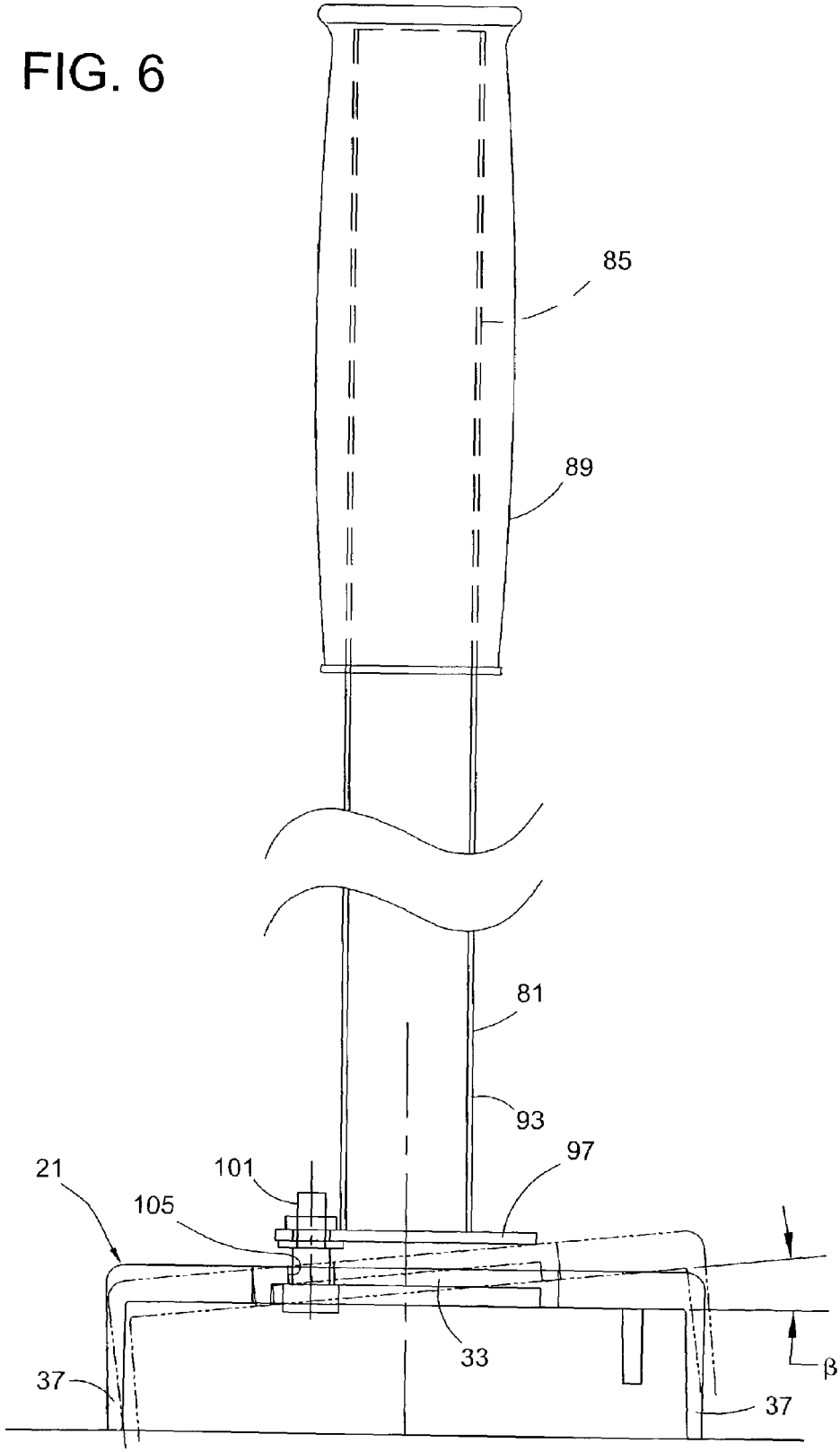
FIG. 6 is an elevation of the tool of FIG. 1 with an extension installed.

Referring now to FIG. 6, another configuration of the tool 21 comprises an extension 81 extending from the hub 33. The extension 81 facilitates manipulation of the fingers 37 and hub 33 from a location remote of the fingers and hub. The extension 81 is particularly useful in installing and removing caps 25 without stooping or bending over to reach the pest control device 29. Instead, the authorized personnel can remove the cap 25 and inspect the device 29 from a standing position. This decreases the amount of stooping or bending over required by the personnel, making inspection of multiple pest control devices 29 more efficient. An upper end 85 of the extension 81 includes a grip 89 to facilitate holding the extension and manipulating the extension and tool 21.

A bottom end 93 of the extension includes a flange 97 that attaches to the hub 33 with at least one bolt 101, and preferably three bolts. The bolts 101 are fixedly received by the flange 97, while the bolts are only loosely received by the tool 21, which includes holes 105 larger than the bolts themselves (FIGS. 1 and 6). For example, the holes 105 may have a diameter of about 0.79 centimeter (0.31 inch) while the bolts are about 0.64 centimeter (0.25 inch) in diameter. The interaction between the bolts 101 and the oversized holes 105 allows the extension 81 to pivot with respect to the hub 33 and fingers 37 of the tool 21 as shown in FIG. 6. This pivoting motion facilitates seating the tool 21 on the cap 25, because if the user does not precisely position the extension 81 perpendicular to the cap, the socket 39 of the tool can pivot on the extension to the correct orientation for receiving the cap. In other words, the extension 81 can pivot slightly with respect to the hub 33 of the tool 21 such that the fingers 37 may engage the cap 25 with the extension in a plurality of orientations. The extension 81 and hub 33 of the tool 21 are ideally perpendicular to one another during use, but the hub and fingers 37 may pivot with respect to the extension an angle β, as depicted in FIG. 6. Preferably, β is between about five degrees and about ten degrees, and more particularly about seven degrees.

The extension 81 preferably has a length of about 87.2 centimeters (34.3 inches) and is formed from metal tubing, such as steel. Such tubing, for example, may have a thickness of about 0.089 centimeter (0.035 inch). Other materials, lengths and thicknesses may be used without departing from the scope of the present invention.

In operation, the present invention contemplates a method for removing the cap 25 from the pest control device 29. The method comprises a step of engaging the fingers 37 of the tool 21 with the side edge 41 of the cap 25 of the pest control device 29. This step occurs substantially as set forth above with a tool 21 having either an extension 81 or a handle 61. After engagement, the tool 21 is rotated such that the cap 25 rotates conjointly and disengages from the pest control device 29. In particular, the rotating step may further comprise disengaging a pair of tabs 111 of the cap 25 from cavities 115 of the bait holder 30 of the pest control device 29 (FIGS. 2 and 4). The pest control device may require counter-clockwise or clockwise rotation of the tool 21 for disengagement of the cap 25 without departing from the scope of the present invention. Finally, the method comprises lifting the tool 21 from the pest control device 29 to lift the disengaged cap 25 from the pest control device.

The invention also includes a method for installing the cap 25 on the pest control device 29. The method comprises a step of engaging the fingers 37 of the tool 21 with the side edge 41 of the cap 25 of the pest control device, as described above. The method further comprises engaging the cap 25 against the pest control device 29 with the tool 21 and rotating the tool such that the cap is retained by the pest control device. More particularly, the rotating step further comprises inserting tabs 111 of the cap 25 within cavities 115 of the bait holder 30 of the pest control device 29. The tabs 111 include a chamfer 121 along a leading edge of the tab. As the cap 25 rotates into position, the chamfer 121 helps guide the tab 111 into position within the cavity 115. The method additionally comprises lifting the tool 21 from the pest control device 29 to disengage the tool from the cap 25, thereby leaving the pest control device properly capped.

In view of the above, it will be seen that the several objects of the invention are achieved and other advantageous results attained.

When introducing elements of the present invention or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements.

As various changes could be made in the above without departing from the scope of the invention, it is intended that all matter contained in the above description and shown in the accompanying drawings shall be interpreted as illustrative and not in a limiting sense.

What is claimed is:

1. A tool for removing a cap from a pest control device, said cap having a top and a sidewall depending from said top, the tool comprising:

a hub and at least three fingers depending from the hub in circumferentially spaced relationship with each other to cooperatively define a socket for receiving the cap within the tool, the fingers being resiliently moveable relative to the hub upon receiving the cap into the socket whereby the fingers are biased laterally inward against the sidewall of the cap when the cap is received in the socket; and at least three stops extending from said fingers laterally inward of the socket, said stops being adapted for contacting the top of the cap upon receipt of the cap within the socket such that said fingers and stops cooperate to orient said tool on said cap, said tool including an even number of fingers and half as many stops, said stops extending from every other finger.

2. A tool as set forth in claim 1 wherein said fingers are arranged parallel to one another.

3. A tool as set forth in claim 1 wherein said fingers angle slightly inward from parallel toward one another.

4. A tool as set forth in claim 3 wherein said fingers angle slightly inward from parallel toward one another at an angle between about one degree and about five degrees.

5. A tool as set forth in claim 4 wherein said angle is about two degrees.

6. A tool as set forth in claim 1 further comprising an extension extending from said hub, said extension facilitating manipulation of said fingers and hub from a location remote of said fingers and hub.

7. A tool as set forth in claim 6 wherein said extension attaches to said hub with at least one bolt.

8. A tool as set forth in claim 7 wherein said bolt is loosely received by said extension, thereby allowing said extension to move slightly with respect to said hub such that said fingers may engage said cap with the extension in a plurality of orientations.

9. A tool as set forth in claim 8 wherein said hub and said fingers may pivot with respect to the extension at an angle of between about five degrees and about ten degrees.

10. A tool as set forth in claim 9 wherein said angle is about seven degrees.

11. A tool as set forth in claim 1 further comprising a handle attached to at least one of said fingers for manipulating said tool.

12. A tool as set forth in claim 11 wherein said handle is generally U-shaped for manually grasping the tool.

* * * * *